US006614157B2

(12) United States Patent
Matsuo et al.

(10) Patent No.: US 6,614,157 B2
(45) Date of Patent: Sep. 2, 2003

(54) CATHODE-RAY TUBE

(75) Inventors: Keiji Matsuo, Takatsuki (JP); Hiroji Morimoto, Kashiwara (JP); Akira Hayashi, Suita (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/088,006

(22) PCT Filed: Jul. 11, 2001

(86) PCT No.: PCT/JP01/06031

§ 371 (c)(1),
(2), (4) Date: Mar. 12, 2002

(87) PCT Pub. No.: WO02/09139

PCT Pub. Date: Jan. 31, 2002

(65) Prior Publication Data

US 2002/0153825 A1 Oct. 24, 2002

(30) Foreign Application Priority Data

Jul. 24, 2000 (JP) ..... 2000-222300

(51) Int. Cl.[7] ..... H01J 29/74
(52) U.S. Cl. ..... 313/440; 313/414; 313/439
(58) Field of Search ..... 313/440, 414, 313/412, 426, 432, 439

(56) References Cited

U.S. PATENT DOCUMENTS 6,133,685 A 10/2000 Konda et al.
6,144,151 A 11/2000 Tojo et al.

FOREIGN PATENT DOCUMENTS

| | | |
|---|---|---|
| EP | 0 484 606 | 5/1992 |
| EP | 0 592 038 | 4/1994 |
| JP | 5-347131 | 12/1993 |
| JP | 8-115684 | 5/1996 |
| JP | 10-74465 | 3/1998 |
| JP | 10-255689 | 9/1998 |
| JP | 11-162372 | 6/1999 |
| JP | 2000-188067 | 7/2000 |
| WO | WO 97/07523 | 2/1997 |

*Primary Examiner*—Vip Patel
(74) *Attorney, Agent, or Firm*—Merchant & Gould, P.C.

(57) ABSTRACT

A cathode-ray tube comprising an electron gun (4) disposed in the neck portion (3) of a funnel (2), a deflection yoke (5) having a horizontal deflection coil (51) and a vertical deflection coil (52) mounted on the outer surface of the funnel (2) in a position closer to the front panel than the electron gun (4), and a speed modulation coil (6) mounted on the outer surface of the neck portion (3). The speed modulation coil (6) is so disposed that the end part thereof on the front panel side is closer to the electron gun (4) than the end part of the horizontal deflection coil (51) facing the electron gun (4) and closer to the front panel side the end part of the electron gun (4) facing the front panel. A desired speed modulation effect can be attained because the speed modulation magnetic field (28) of the speed modulation coil (6) does not interfere with the deflection magnetic field and can be prevented from disappearing by causing by causing an eddy current in a top unit (27).

5 Claims, 8 Drawing Sheets

CATHODE-RAY TUBE

TECHNICAL FIELD

The present invention relates to a cathode ray tube device, and it relates, in particular, to a structure near an electron gun and a velocity modulation coil.

BACKGROUND ART

FIG. 3 is a lateral cross-sectional view showing a cathode ray tube device. As shown in FIG. 3, the cathode ray tube device includes a cathode ray tube, a deflection yoke 5, a convergence yoke 7 and velocity modulation coils 6. The cathode ray tube has a front panel 1 whose inner surface is provided with a phosphor screen 8, a funnel 2 and an electron gun 4 provided inside a neck portion 3 of the funnel 2. The deflection yoke 5 has horizontal deflection coils and vertical deflection coils that are mounted on an outer surface of the funnel 2 and positioned on the side of the front panel 1 with respect to the electron gun 4. The convergence yoke 7 is provided on an outer surface of the neck portion 3.

FIG. 11 is a lateral cross-sectional view of the neck portion 3. The electron gun 4 (shown not as a cross-sectional view) has a structure in which a cathode 21, a control electrode (a G1 electrode) 22, an accelerating electrode (a G2 electrode) 23, a focusing electrode (a G3 electrode) 24 and an anode 25 having a G4 electrode 26 and a top unit 27 are arranged sequentially. The top unit 27 is a cup-shaped member having a cylindrical portion and a bottom portion that is provided with an electron beam passing hole. Until electron beams 9 (shown in FIG. 3) emitted from the cathode 21 reach the phosphor screen 8 formed on the inner surface of the front panel 1, their paths are deflected by an ac magnetic field generated by the deflection yoke 5, the velocity modulation coils 6 (which are not true to life in FIG. 11 for the sake of convenience, but actually are formed as shown in FIG. 2) and the convergence yoke 7. The deflection yoke 5 includes horizontal deflection coils 51 for deflecting the paths horizontally and vertical deflection coils 52 for deflecting the paths vertically and is mounted on a cone portion of the funnel 2. The deflection yoke 5 generates the ac magnetic field so as to deflect the paths of the electron beams, thereby scanning the phosphor screen with the electron beams. The convergence yoke 7 is mounted outside the neck portion 3 and focuses the three electron beams on one point by its magnetic field.

In a current advanced display technology, the magnetic field is modulated by the velocity modulation coils 6 so as to perform what is called a velocity modulation of electron beams, thereby improving the focus performance (see JP 10(1998)-74465 A). The velocity modulation coils 6 are each arranged between the convergence yoke 7 and the neck portion 3 and at a position where the G3 electrode 24 and the G4 electrode 26 are located. The velocity modulation coils 6 generate an ac magnetic field 28 (shown as "a barrel shape" with dashed lines) so as to modulate a scanning velocity of the electron beams, thereby realizing a high-brightness portion and a low-brightness portion on the phosphor screen, thus achieving a sharp image.

The frequency of the ac magnetic field 28 for modulating the electron beams is of the order of a megahertz, as high as a video frequency. Therefore, when the velocity modulation coils 6 are provided at the position shown in FIG. 11, the ac magnetic field 28 is attenuated by the G3 electrode 24 and the G4 electrode 26, which are formed of a metallic material such as stainless steel, causing a problem in that the electron beams cannot be modulated in a desired manner. In other words, the ac magnetic field 28 generates eddy currents in the G3 electrode 24 and the G4 electrode 26, causing a loss of the ac magnetic field 28.

Conventionally, it has been suggested that an electrode formed by deep-drawing should be divided into several parts, which are then spaced away from each other so as to improve magnetic permeability (see JP 8(1996)-115684 A). However, when the distance between the electrodes in the electron gun are designed to be great, an electric potential permeating into the neck portion separates the three electron beams that have been focused on one point on the phosphor screen, causing a problem in practical use. There also have been problems in that an assembling accuracy lowers, costs increase, and the magnetic permeability cannot be improved considerably because the size of each component should not be reduced too much in order to maintain a mechanical strength of each of the divided electrodes.

In addition, it is suggested in JP 5(1993)-347131 A that velocity modulation coils should be provided to overlap horizontal deflection coils, thus forming a portion in which an electrode of an electron gun and the velocity modulation coil do not overlap each other, thereby improving a modulation sensitivity of the velocity modulation coil. In this case, the frequency of an ac magnetic field from the velocity modulation coils is of the order of a megahertz and higher than the video frequency, and therefore, this ac magnetic field interferes with the magnetic field from the horizontal deflection coils, thus deteriorating signals of a television device. This leads to a poor image quality, becoming inappropriate for a practical use.

DISCLOSURE OF INVENTION

The present invention has been made in order to solve the problems described above, and it is an object of the present invention to provide a cathode ray tube device that can achieve a desired modulation effect on electron beams without blocking permeation of a velocity modulation magnetic field from an external side of a cathode ray tube.

A first cathode ray tube device of the present invention includes a cathode ray tube including a front panel, a funnel and an electron gun that is provided inside a neck portion of the funnel, a deflection yoke including a horizontal deflection coil and a vertical deflection coil that are mounted on an outer surface of the funnel and positioned on a side of the front panel with respect to the electron gun, and a velocity modulation coil that is mounted on an outer surface of the neck portion. An end of the velocity modulation coil on the side of the front panel is positioned on a side of the electron gun with respect to an end of the horizontal deflection coil on the side of the electron gun and is positioned on the side of the front panel with respect to an end of the electron gun on the side of the front panel.

With the above structure, since the horizontal deflection coil of the deflection yoke and the velocity modulation coil do not overlap in a direction perpendicular to a tube axis of the cathode ray tube, no interference from these coils deteriorates signals of a television device so as to cause a poor image quality. Also, because at least a part of the velocity modulation coil on the side of the front panel does not overlap a screen-side end of an electrode of the electron gun in the direction perpendicular to the tube axis of the cathode ray tube, it is possible to reduce a loss of an ac magnetic field from the velocity modulation coil owing to eddy currents, thereby achieving a desired modulation effect on electron beams.

It also is preferable that a distance along a tube axis direction of the cathode ray tube between the end of the velocity modulation coil on the side of the front panel and the end of the electron gun on the side of the front panel is at least 10% of a length of the velocity modulation coil along the tube axis direction. With this structure, it is possible to reduce the loss of the ac magnetic field from the velocity modulation coil owing to the eddy currents, thereby achieving a desired modulation effect on electron beams.

Furthermore, it is preferable that a distance along a tube axis direction of the cathode ray tube between the end of the velocity modulation coil on the side of the front panel and the end of the electron gun on the side of the front panel is at least 1 mm and not greater than 10 mm. With this structure, it is possible to reduce the loss of the ac magnetic field from the velocity modulation coil owing to the eddy currents, thereby achieving a desired modulation effect on electron beams.

Moreover, it is preferable that a component at the end of the electron gun on the side of the front panel includes a cylindrical component, and that the cylindrical component has a length along a tube axis direction of 10% to 30% of an outer diameter of the cylindrical component. With this structure, it is possible to prevent problems such as a strength decrease, a decrease in the insulation between an electrically conductive film applied onto an inner surface of the neck portion of the cathode ray tube and a G3 electrode, and an adverse effect of an electric potential of the electrically conductive film on a main lens while maintaining a short top unit of the electron gun.

It also is preferable that a cylindrical portion of the cylindrical component is provided with an opening. With this structure, providing the opening decreases a total amount of the eddy currents, thus achieving a sufficient loss-reduction effect.

Furthermore, it is preferable that a front-panel-side end of a cylindrical portion of the cylindrical component is provided with a notch. With this structure, providing the notch decreases a total amount of the eddy currents, thus achieving a sufficient loss-reduction effect.

A second cathode ray tube device of the present invention includes a cathode ray tube including a front panel, a funnel and an electron gun that is provided inside a neck portion of the funnel, a deflection yoke including a horizontal deflection coil and a vertical deflection coil that are mounted on an outer surface of the funnel and positioned on a side of the front panel with respect to the electron gun, and a velocity modulation coil that is mounted on an outer surface of the neck portion. A component at an end of the electron gun on the side of the front panel includes a cylindrical portion and a coil-shaped portion that is provided on the side of the front panel with respect to the cylindrical portion. An end of the velocity modulation coil on the side of the front panel is positioned on a side of the electron gun with respect to an end of the horizontal deflection coil on the side of the electron gun and is positioned on the side of the front panel with respect to an end of the cylindrical portion of the electron gun on the side of the front panel.

With the above structure, since reducing the generation of the eddy currents in the coil-shaped portion allows the velocity modulation magnetic field to permeate through the coil-shaped portion efficiently, it is possible to achieve a desired velocity modulation effect over a wide range of frequencies.

It also is preferable that a space between adjacent wires of the coil-shaped portion is not greater than 2.5 mm. With this structure, since the velocity modulation magnetic field can permeate through the coil-shaped portion efficiently, it is possible to achieve a desired velocity modulation effect over a wide range of frequencies.

Furthermore, it is preferable that adjacent wires of the coil-shaped portion are in contact with each other. With this structure, since the generation of the eddy currents is smaller than in the case of a cylindrical top unit, which allows the velocity modulation magnetic field to permeate through the coil-shaped portion more easily, it is possible to achieve a desired velocity modulation effect over a wide range of frequencies.

BEST MODE FOR CARRYING OUT THE INVENTION

The following is a description of a cathode ray tube device of the present invention, with reference to the accompanying drawings. An overall description will be omitted here, and the vicinity of velocity modulation coils, which is a main portion of the present invention, will be described in detail.

FIRST EMBODIMENT

Figure 1:
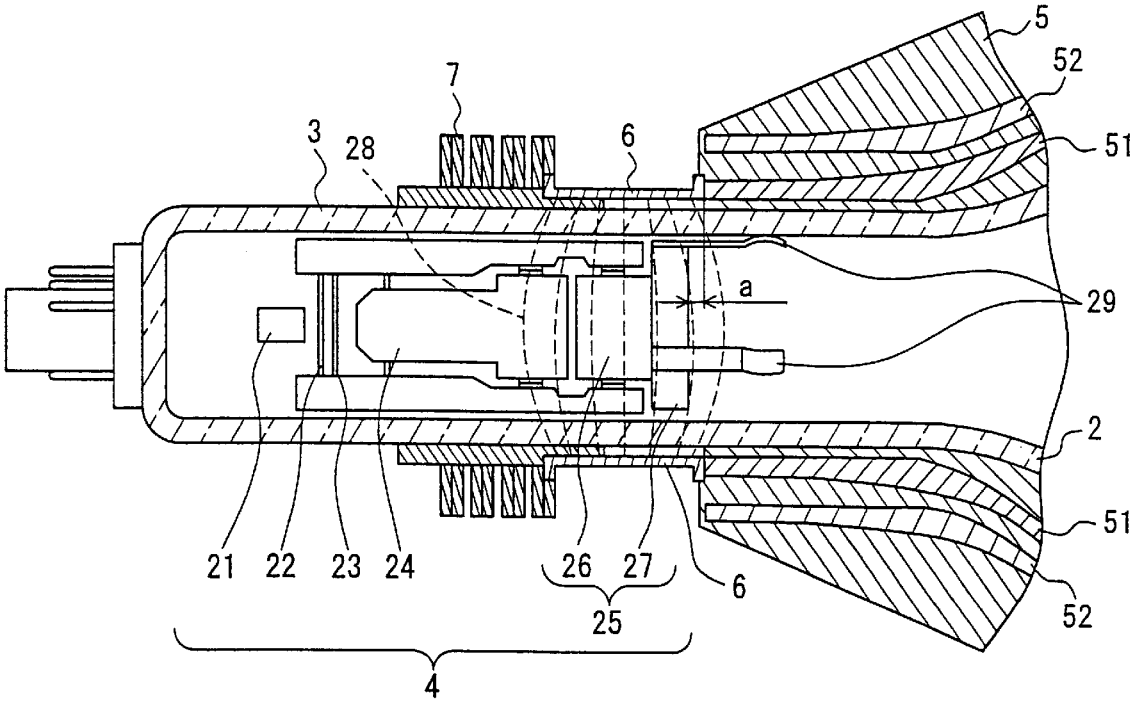
FIG. 1 is an enlarged cross-sectional view showing a vicinity of velocity modulation coils of a cathode ray tube device of the present invention.

FIG. 1 is a lateral cross-sectional view showing a vicinity of a neck portion of a cathode ray tube device of the present invention. An electron gun 4 has a basic structure similar to a conventional electron gun and includes a cathode 21, a G1 electrode 22, a G2 electrode 23, a G3 electrode 24 that is arranged at a predetermined distance from the G2 electrode 23 and an anode 25 that is arranged at a predetermined distance from the G3 electrode 24. The anode 25 has a G4 electrode 26 that forms a main lens between itself and the G3 electrode 24 and a cylindrical top unit ("a cylindrical component") 27 that is provided on the side of a phosphor screen with respect to the G4 electrode 26 and for supporting the electron gun 4 and conducting a high voltage. The top unit 27 is made of stainless steel. Voltages of about 1 kV, about 5 to 10 kV and about 20 to 35 kV are applied to the G2 electrode 23, the G3 electrode 24 and the G4 electrode 26, respectively. The top unit 27 is provided with a plurality of (three, in the present embodiment) strap-like centering springs 29 that protrude toward the screen side and are spaced away from each other in a substantially equiangular manner. By contacting an inner surface of a neck portion 3, the centering springs 29 support the electron gun 4 and make an electrical conduction with an electrically conductive film (not shown in the figure) formed on the inner surface of the neck portion 3, whereby the above-mentioned voltage is applied to the G4 electrode 26 via the top unit 27.

Along an outer surface of a funnel 2, a deflection yoke 5 (shown in a simplified manner) is mounted. The deflection yoke 5 includes horizontal deflection coils 51 for deflecting electron beams horizontally and vertical deflection coils 52 for deflecting them vertically.

Figure 11:
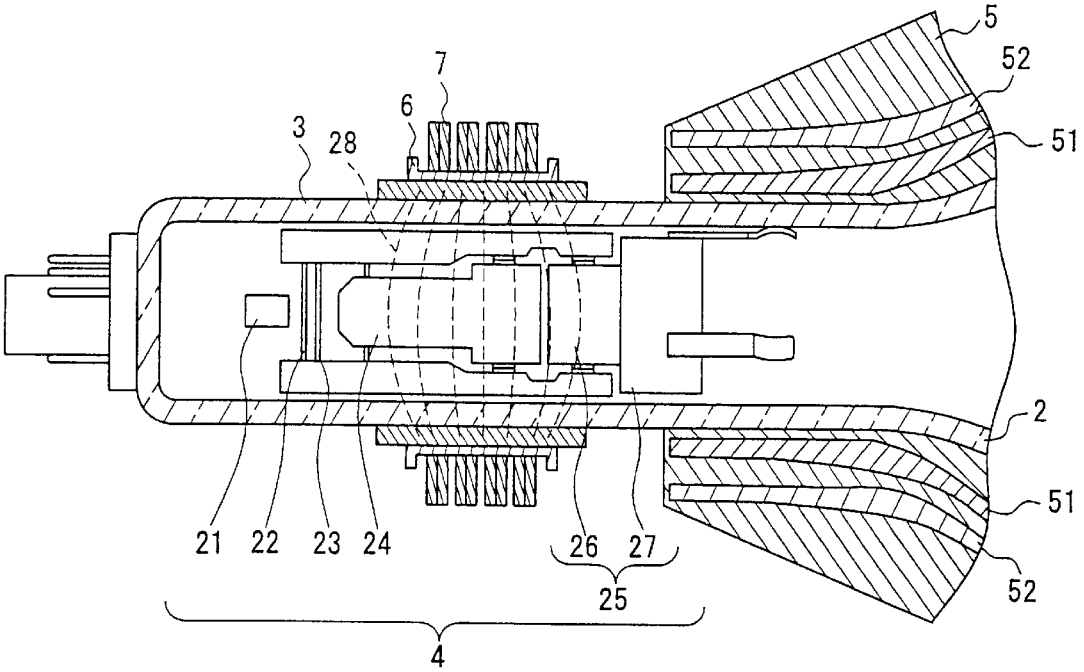
FIG. 11 is an enlarged cross-sectional view showing a vicinity of velocity modulation coils of a conventional cathode ray tube device.

An end of a velocity modulation coil 6 (which is not true to life as in FIG. 11) on the side of a front panel 1 is positioned on the side of the electron gun 4 with respect to an end of the horizontal deflection coil 51 on the side of the electron gun 4 and is positioned on the side of the front panel 1 with respect to an end of the electron gun 4 on the side of the front panel 1. In the present embodiment, the "end of the electron gun 4 on the side of the front panel 1" means the end of the top unit 27 on the side of the front panel 1 and does not include the centering springs 29. A minimum distance required for maintaining insulation is provided desirably between the horizontal deflection coil 51 and the velocity modulation coil 6. However, when both the coils are provided with an insulating coating, they may be adjoined to each other.

Figure 2:
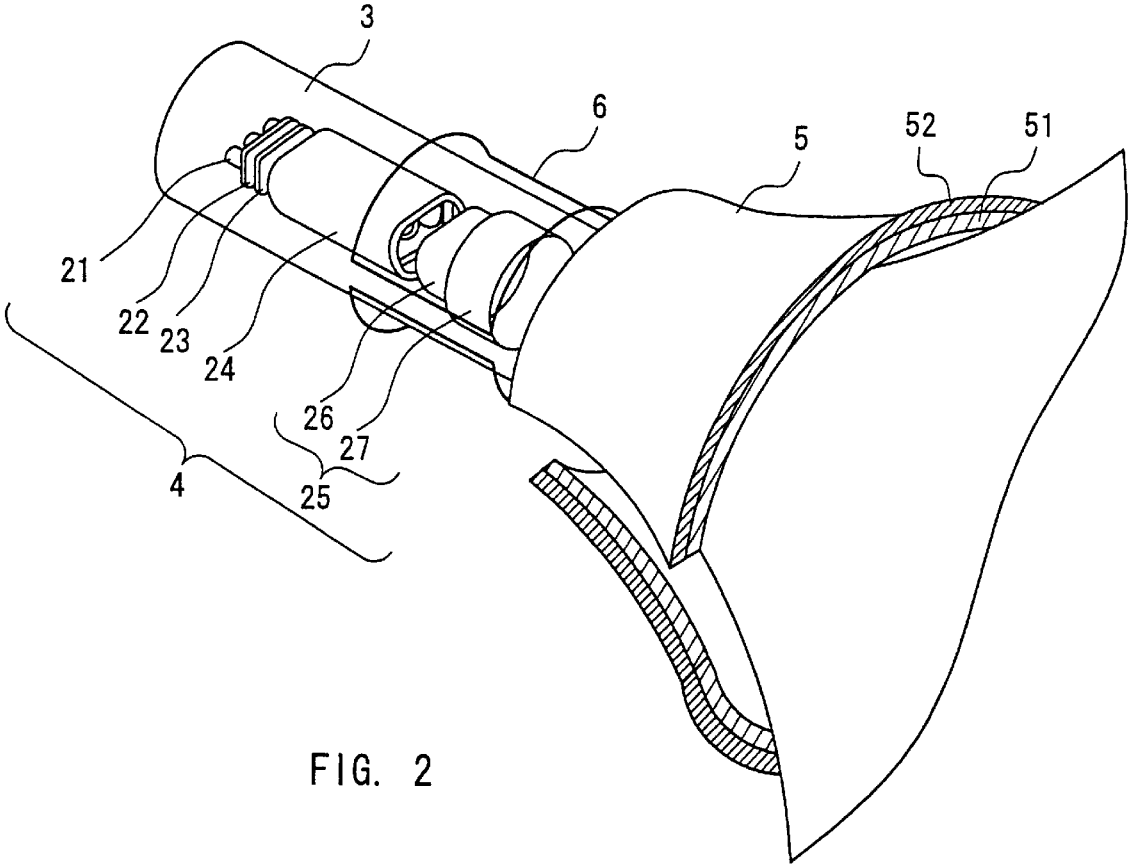
FIG. 2 is a perspective view showing the velocity modulation coils of the cathode ray tube device of the present invention.
Figure 3:
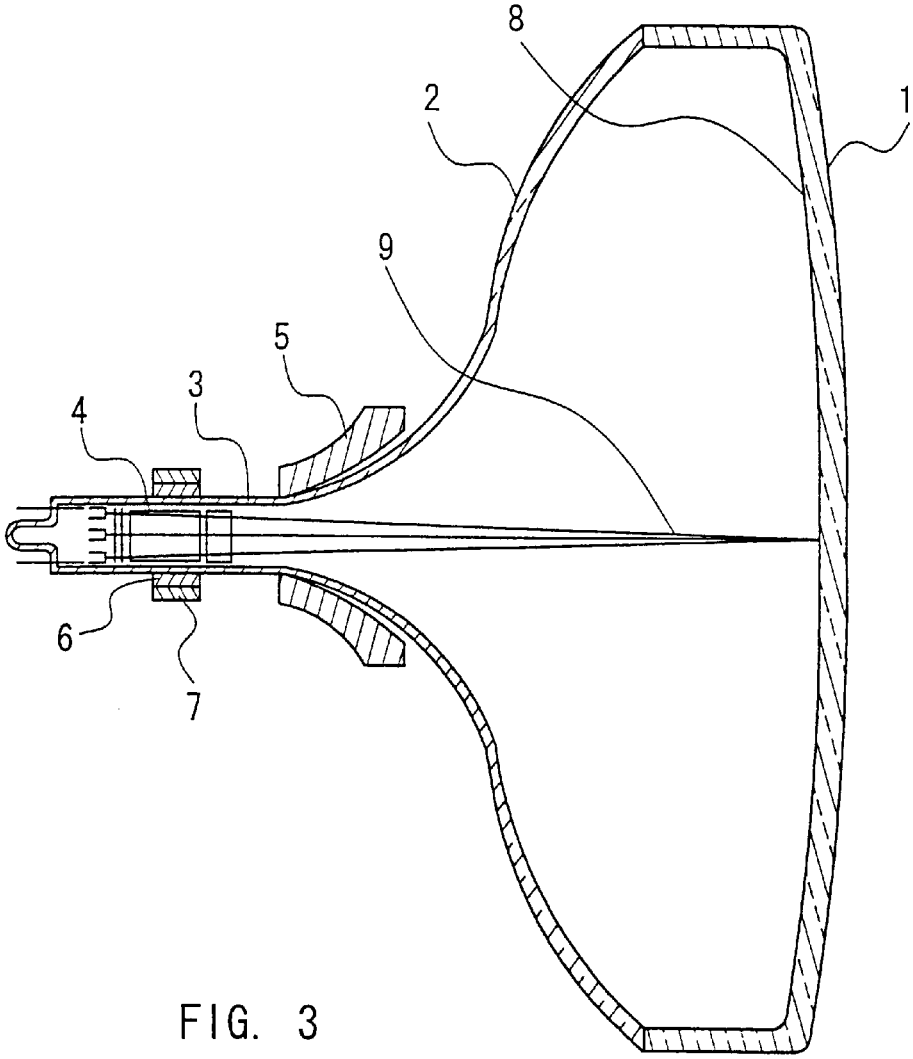
FIG. 3 is a lateral cross-sectional view of a cathode ray tube device.

FIG. 2 is a perspective view of the neck portion 3, which shows the shape of the velocity modulation coils 6 and how they are mounted on the neck portion 3. Along the neck portion 3, one velocity modulation coil 6 is provided above and one is provided below the neck portion 3.

When the distance along a tube axis direction of the cathode ray tube between the end of the velocity modulation coil 6 on the side of the front panel 1 and the end of the top unit 27 on the side of the front panel 1 is expressed by a (shown by a dimension line in FIG. 1), an increase in the distance a can reduce a loss owing to eddy currents generated in the G3 electrode 24 and the anode 25. More specifically, it is preferable that the distance a is set to be 1 mm or greater. When the distance a is 3 mm or greater, the loss further is reduced. However, the distance a greater than 10 mm is not preferable because it becomes necessary to elongate a neck tube. The distance a of at least 10% of the length of the velocity modulation coil 6 along the tube axis direction of the cathode ray tube can bring about a sufficient loss-reduction effect.

The top unit 27 has an outer diameter of about 24.4 mm when the neck portion 3 has an outer diameter of ϕ32.5 mm, that of about 22.3 mm when the neck portion 3 has an outer diameter of ϕ29.1 mm, and that of about 15.3 mm when the neck portion 3 has an outer diameter of ϕ22.5 mm. The length of the top unit 27 along the tube axis direction of the cathode ray tube is about 5 mm in the present invention, while that of the conventional cathode ray tube is about 10 mm. The top unit 27 preferably has a length ranging from 10% to 30% of the outer diameter of the top unit 27. An excessively short top unit 27 is not preferable because of various problems, such as a decrease in the strength of the top unit 27, a decrease in the insulation between an electrically conductive film (not shown in the figure) applied onto the inner surface of the neck portion 3 and the G3 electrode 24, and an adverse effect of an electric potential of the electrically conductive film on the main lens. On the other hand, an excessively long top unit 27 also is not preferable because the distance a decreases, lowering the loss-reduction effect.

Figure 10:
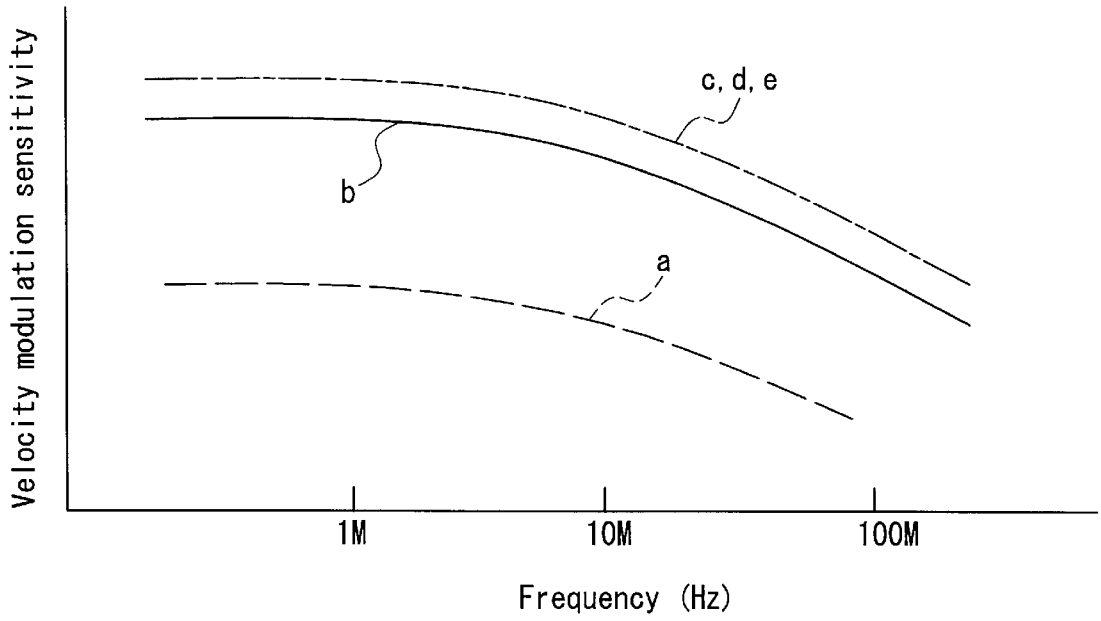
FIG. 10 is a view for showing the relationship between a frequency of a velocity modulation magnetic field and a velocity modulation sensitivity.

FIG. 10 indicates an effect of the present invention, and shows the relationship between a frequency of a velocity modulation magnetic field and a velocity modulation sensitivity. The "velocity modulation sensitivity" serving as the ordinate indicates how much the electron beam paths change when a constant power (electric current) is inputted to the velocity modulation coils and indicates relatively how much the landing spots of the electron beams on the phosphor screen move in a transverse direction. A larger value indicates a larger effect of the magnetic modulation. In FIG. 10, a curve a and a curve b indicate the case of the conventional cathode ray tube device in which the velocity modulation coils 6 are provided at the position shown in FIG. 11 and the case of the present invention, respectively. It is shown that, according to the present invention, a velocity modulation effect larger than the conventional one can be obtained over a wide range of frequencies.

SECOND EMBODIMENT

In the present embodiment, a cylindrical portion (a cylindrical surface portion) of the top unit is provided with openings. Other portions have the same structure as in the first embodiment.

Figure 4:
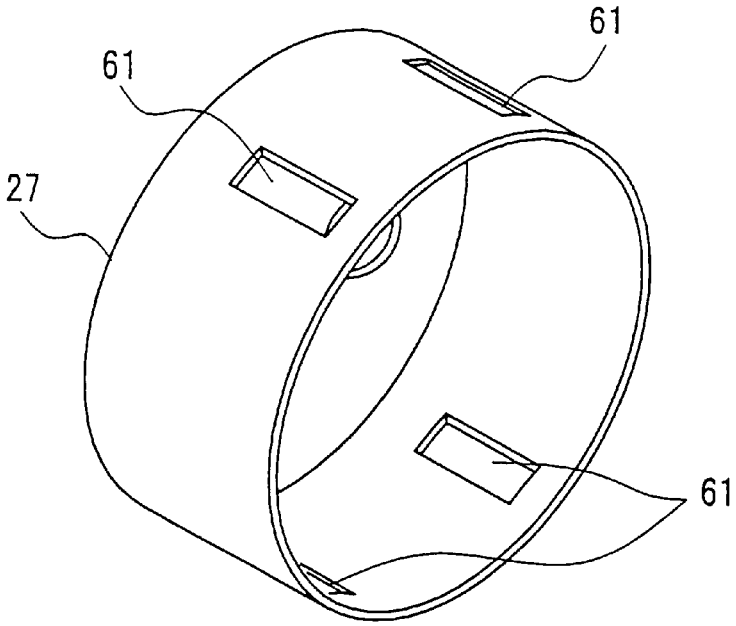
FIG. 4 is a perspective view showing a top unit according to a second embodiment of the present invention.

FIG. 4 is a perspective view of the top unit 27. Four rectangular openings 61 whose longer sides are 3 mm long and shorter sides are 0.5 mm long are provided in the cylindrical portion of the top unit 27. The openings 61 are located symmetrically with respect to a horizontal deflection direction and a vertical deflection direction.

The effect of the present embodiment is indicated by a curve c shown in FIG. 10. It is shown that, according to the present embodiment, a velocity modulation effect larger than that in the case of the first embodiment (the curve b) can be obtained over a wide range of frequencies. This is because providing the openings 61 decreases a total amount of the eddy currents, thus achieving a sufficient loss-reduction effect.

THIRD EMBODIMENT

In the present embodiment, a front-panel-side end of the cylindrical portion (the cylindrical surface portion) of the top unit is provided with notches. Other portions have the same structure as in the first embodiment.

Figure 5:
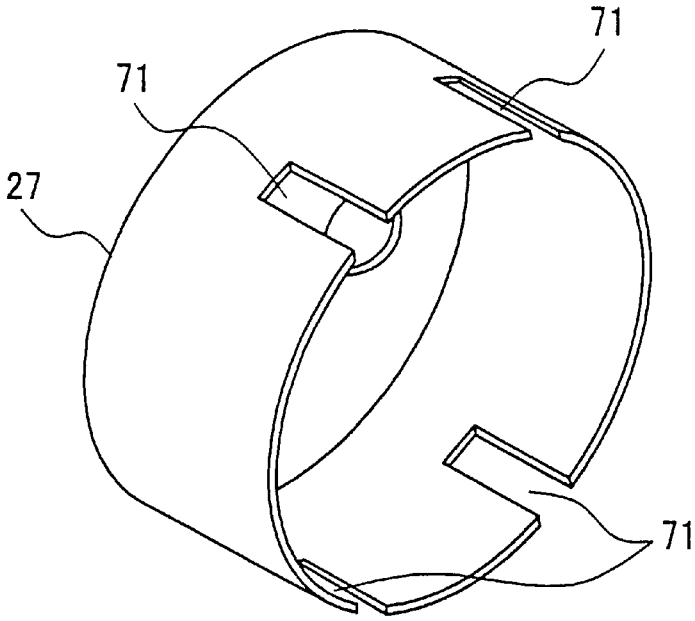
FIG. 5 is a perspective view showing a top unit according to a third embodiment of the present invention.

FIG. 5 is a perspective view of the top unit 27. Four rectangular notches 71 whose longer sides are 3 mm long (deep) and shorter sides are 0.5 mm long are provided at the front end of the cylindrical portion of the top unit 27. The notches 71 are located symmetrically with respect to the horizontal deflection direction and the vertical deflection direction.

The effect of the present embodiment is indicated by a curve d shown in FIG. 10. It is shown that, according to the present embodiment, a velocity modulation effect larger than that in the case of the first embodiment (the curve b) can be obtained over a wide range of frequencies. This is because providing the notches 71 decreases a total amount of the eddy currents, thus achieving a sufficient loss-reduction effect. Furthermore, providing the notches 71 can bring about a smaller loop of the eddy current compared with the openings 61 of the second embodiment.

FOURTH EMBODIMENT

In the present embodiment, the top unit includes a cylindrical portion and a coil-shaped portion. Also, the present embodiment is characterized in that the velocity modulation coils 6 are located in a position different from those in the above-described embodiments.

Figure 6:
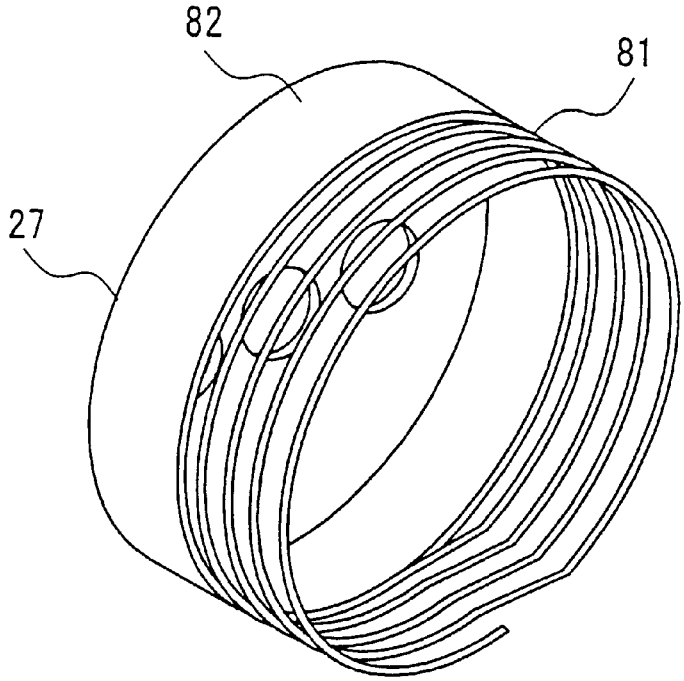
FIG. 6 is a perspective view showing a top unit according to a fourth embodiment of the present invention.
Figure 7:
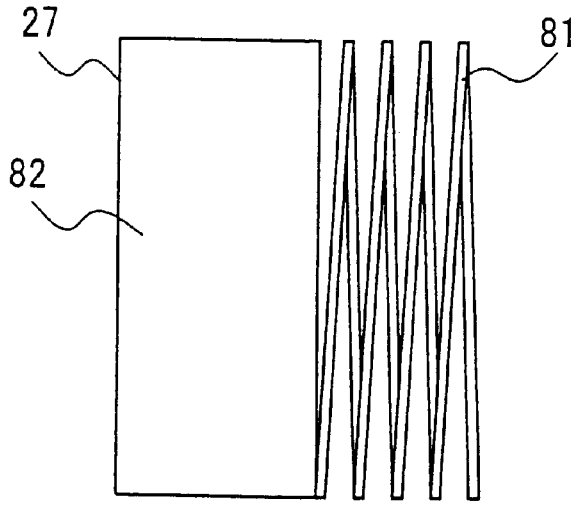
FIG. 7 is a lateral view showing the top unit according to the fourth embodiment of the present invention.

FIG. 6 is a perspective view of the top unit 27, and FIG. 7 is a lateral view thereof. The top unit 27 includes a cylindrical portion 82 and a coil-shaped portion 81 provided on the side of the front panel 1 (not shown in these figures) with respect to the cylindrical portion 82. The location of the velocity modulation coils 6 is not shown in these figures, but the end of the velocity modulation coil 6 on the side of the front panel 1 is positioned on the side of the electron gun 4 with respect to the end of the horizontal deflection coil 51 on the side of the electron gun 4 and is positioned on the side of the front panel 1 with respect to the end of the cylindrical portion 82 of the top unit 27 on the side of the front panel 1.

In the present embodiment, the distance a described in the first embodiment is measured based not on the front end of the top unit 27 but on the front end of the cylindrical portion 82. A preferable value of the distance a is the same as that in the first embodiment.

A wire for the coil-shaped portion 81 has a thickness of 0.3 mm. It is referable that the space between adjacent wires is 0 to 2.5 mm.

The effect of the present embodiment in the case where the space between the adjacent wires is 2.5 mm is indicated by a curve e shown in FIG. 10. It is shown that, according to the present embodiment, a velocity modulation effect larger than that in the case of the first embodiment (the curve b) can be obtained over a wide range of frequencies. This is because the loss in the coil-shaped portion 81 owing to the eddy currents is small and, thus, the velocity modulation magnetic field permeates through the coil-shaped portion 81 efficiently.

Figure 8:
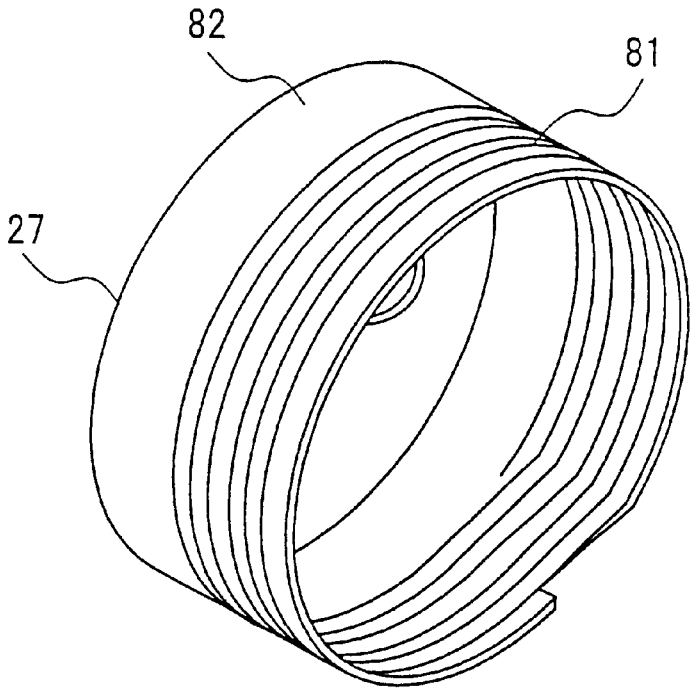
FIG. 8 is a perspective view showing another top unit according to the fourth embodiment of the present invention.
Figure 9:
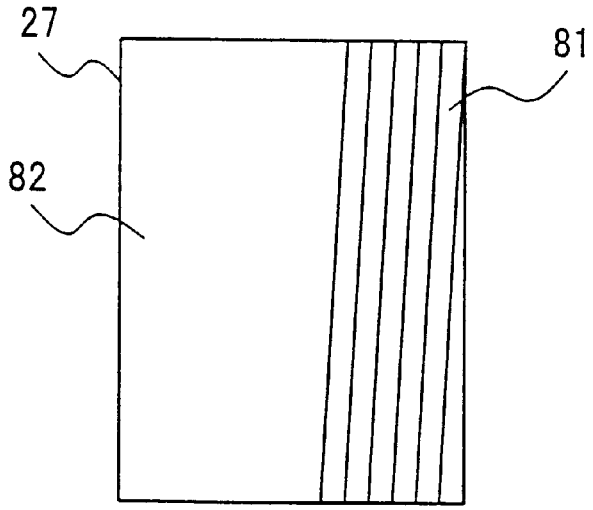
FIG. 9 is a lateral view showing the top unit according to the fourth embodiment of the present invention.

When the space between the adjacent wires is 0 mm, the adjacent wires are in contact with each other as shown in FIGS. 8 and 9. In this case, it also is possible to achieve a sufficient modulation magnetic field permeating effect that is larger compared with the case of a completely seamless cylindrical shape, for example, where one plate material is processed by deep-drawing. However, in order to achieve a still larger modulation effect, it is preferable that at least some space is provided between the adjacent wires. On the other hand, the space between the adjacent wires of greater than 2.5 mm is not preferable because the susceptibility to an external magnetic field rises.

Although the present invention has been applied to a color cathode ray tube device in the above description, it may be applied to a monochrome cathode ray tube device.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A cathode ray tube device comprising:

a cathode ray tube comprising a front panel, a funnel and an electron gun that is provided inside a neck portion of the funnel;

a deflection yoke comprising a horizontal deflection coil and a vertical deflection coil that are mounted on an outer surface of the funnel and positioned on a side of the front panel with respect to the electron gun; and a velocity modulation coil that is mounted on an outer surface of the neck portion;

wherein the electron gun comprises a G4 electrode and a G3 electrode sequentially from the side of the front panel, and a main lens is formed between the G4 electrode and the G3 electrode, an end of the velocity modulation coil on the side of the front panel is positioned on a side of the electron gun with respect to an end of the horizontal deflection coil on the side of the electron gun and is positioned on the side of the front panel with respect to an end of the electron gun on the side of the front panel, and in a direction perpendicular to a tube axis of the cathode ray tube, the velocity modulation coil and the G4 electrode are opposed to each other.

2. The cathode ray tube device according to claim 1, wherein a distance along a tube axis direction of the cathode ray tube between the end of the velocity modulation coil on the side of the front panel and the end of the electron gun on the side of the front panel is at least 10% of a length of the velocity modulation coil along the tube axis direction.

3. The cathode ray tube device according to claim 1, wherein a distance along a tube axis direction of the cathode ray tube between the end of the velocity modulation coil on the side of the front panel and the end of the electron gun on the side of the front panel is at least 1 mm and not greater than 10 mm.

4. The cathode ray tube device according to claim 1, wherein a component at the end of the electron gun on the side of the front panel comprises a cylindrical component, and the cylindrical component has a length along a tube axis direction of 10% to 30% of an outer diameter of the cylindrical component.

5. The cathode ray tube device according to claim 4, wherein a cylindrical portion of the cylindrical component is provided with an opening.

* * * * *